US008303426B2

(12) United States Patent
Crawford et al.

(10) Patent No.: US 8,303,426 B2
(45) Date of Patent: Nov. 6, 2012

(54) ROUND RIDE WITH PASSENGER-INITIATED MOTION PROFILE

(75) Inventors: David W. Crawford, Long Beach, CA (US); Edward Allen Nemeth, Hermosa Beach, CA (US); Paul E. Baker, Porter Ranch, CA (US)

(73) Assignee: Disney Enterprises, Inc., Burbank, CA (US)

( * ) Notice: Subject to any disclaimer, the term of this patent is extended or adjusted under 35 U.S.C. 154(b) by 324 days.

(21) Appl. No.: 12/854,614

(22) Filed: Aug. 11, 2010

(65) Prior Publication Data

US 2012/0040766 A1 Feb. 16, 2012

(51) Int. Cl.
*A63G 1/08* (2006.01)
*A63G 1/30* (2006.01)

(52) U.S. Cl. ..... 472/39; 472/130

(58) Field of Classification Search ..... 472/30, 472/39, 47, 59, 60, 90, 130; 434/247, 253, 434/38, 44
See application file for complete search history.

(56) References Cited

U.S. PATENT DOCUMENTS

| | | | | |
|---|---|---|---|---|
| 2,282,763 | A * | 5/1942 | Kennedy | 472/39 |
| 2,312,533 | A | 3/1943 | Eyerly | |
| 2,468,893 | A * | 5/1949 | Orance | 472/39 |
| 3,104,103 | A * | 9/1963 | Haug | 472/39 |
| 3,603,583 | A * | 9/1971 | Bartlett | 472/39 |
| 4,898,377 | A * | 2/1990 | Roche | 472/30 |
| 5,591,086 | A * | 1/1997 | Kast | 472/130 |
| 7,854,660 | B2 * | 12/2010 | Crawford et al. | 472/39 |
| 2009/0209357 | A1 | 8/2009 | Crawford et al. | |

FOREIGN PATENT DOCUMENTS

| | | | |
|---|---|---|---|
| CN | 201108737 | Y | 9/2008 |
| WO | 2008059356 | A2 | 5/2008 |

OTHER PUBLICATIONS

Extended European search report; Application No. 11171685.8 (EP11171685), dated Nov. 16, 2011, from European Patent Office, Munich.

* cited by examiner

*Primary Examiner* — Kien Nguyen
(74) *Attorney, Agent, or Firm* — Marsh Fischmann & Breyfogle LLP; Kent A. Lembke

(57) ABSTRACT

A round ride with passenger-initiated motion profiles controlling vertical vehicle movements. The ride includes a drive assembly with a rotating hub that includes support arms extending outward from the structure supporting passenger vehicles. Each of the vehicles includes a triggering device capable of generating either an onboard or offboard discrete signal when operated by a passenger causing a controller to select a motion profile from a number of stored profiles that each defines an actuator motion profile (or angular movement of a support arm about its pivotal mounting point to the rotatable central hub). The motion profiles define different angular rotations for a support arm to cause a vehicle to jump to differing heights, and the profile may be chosen by the controller based on vehicle height and position along the circular path and other environmental inputs such as a game state for the vehicle or a show/ride status.

17 Claims, 8 Drawing Sheets

ROUND RIDE WITH PASSENGER-INITIATED MOTION PROFILE

BACKGROUND

1. Field of the Description

The present description relates, in general, to amusement park rides and other entertainment rides such as round rides, and, more particularly, to amusement or theme park rides configured to provide passengers with ride experiences including riders or passengers of each vehicle being able to trigger a vertical impulse, e.g., to uniquely control or at least initiate a vehicle motion profile that may provide jumping or bouncing sensations for passengers of the vehicle at the end of each boom or support arm.

2. Relevant Background

Amusement and theme parks are popular worldwide with hundreds of millions of people visiting the parks each year. Park operators continuously seek new designs for rides that attract and continue to entertain guests. Many parks include round rides that include vehicles or gondolas mounted on support arms extending outward from a centrally located drive or rotation assembly. The passengers or riders sit in the vehicles and are rotated in a circle about the drive assembly, which spins about its central axis. In some of these rides, the guests may operate an interactive device, such as a joystick in the vehicle, to make the support arm and their attached vehicle gradually move upward or downward. Some rides also allow the guests to control the pitch of their vehicle.

While these rides are popular with younger children, these rides are typically not considered an exciting ride that appeals to older guests as the rides often rotate at less than 10 revolutions per minute (RPM) and provide less sophisticated mental stimulation. When designing new rides, park operators have a great amount of freedom to develop rides with very different configurations such as roller coasters and the like that allow the guests to travel at high speeds and experience high accelerations as their vehicles travel around corners and dips. However, park operators face a different challenge when they attempt to refurbish or modify an existing round ride to create a new ride that will appeal to older guests as well as to younger guests. Typically, existing round rides are closely integrated into an area and are surrounded by other elements (e.g., other rides, landscaping, facilities, kiosks, and so on). Therefore, a design challenge is to provide a ride that appeals to older guests within the space currently occupied by the round ride that it is being designed to replace. Even more attractive to the park operator would be a ride configuration that made use of at least some of the original ride components such as the circular drive assembly as this significantly reduces start up costs and allows continued use of a proven drive system.

While existing round rides provide a general soaring or flying experience, the relatively low rotation rate and "generic" or overly predictable experience have been significant barriers to the variability of thrill or excitement that could be provided with a ride based on a round iron ride design. As a consequence, park operators desire a more exciting ride that retains the simplicity, affordability, and appeal for multi-arm rotating rides while increasing passenger enjoyment for all ages such as by increasing the thrill-factor and/or by improving passenger interactivity.

SUMMARY

The present invention addresses the above problems by providing a new type of ride for use in amusement and theme parks that retains the desirable features and the footprint of existing round rides while adding new elements to increase the appeal for older guests. The new rides are configured to allow a passenger to initiate, such as with a user input or trigger device in a vehicle cabin, playback of a motion profile that controls vertical movement of their vehicle along a motion profile or path. Rapid response actuators may be provided for each support arm, and a control system may receive a triggering signal from a vehicle cabin and respond by initiating a motion profile. The motion profile may be selected, in some cases, from a larger set of motion profiles that each define angular rotation of the support arm (or an actuator motion profile that translates into arm movements as well as vertical movements of the supported vehicle). The selection of the motion profile may be based on a location of the vehicle (or hub rotation position) about the circular path (e.g., is the vehicle over a launch or jump zone and, if so, choose a higher jump) or the vehicle's height (or support arm's angular orientation) (e.g., require the vehicle to fall to a base level before initiating a next motion profile, allowing motion profiles or jumps to be additive, and so on). The motion profile may also be modified by the control system based on environmental inputs such as the vehicle (or its passenger's) game status, a state of a ride/show, inputs from other passengers, and so on. In this manner, a passenger is able to interact with the ride by triggering or initiating playback of a motion profile through the control system. The control system acts to select which motion profile to use, acts to modify the characteristics of the profile (e.g., speed, height, and/or the like), and acts to control the actuator (e.g., the passenger does not directly control the arm actuation mechanism).

More particularly, a ride apparatus or round ride is provided for allowing passengers to initiate vehicle movements (e.g., vertical movements such as "jumps"). The ride includes a drive assembly with a structure rotatable about a central axis at one or more rotation speeds. The drive assembly further includes a plurality of support arms extending outward from the structure. In the ride, passenger vehicles are each mounted proximate to an end of one of the support arms apart from the drive assembly. Each of the vehicles includes a triggering device generating a discrete signal when operated by a passenger. The support arms are each pivotally mounted to the structure for angular rotation by an actuator to change their height relative to the ground or a base. The ride also includes a controller in communication with the actuators and the triggering devices. The controller receives the discrete signals from the triggering devices, selects a motion profile based on each of the received discrete signals, and operates the actuators based on the selected motion profiles to move the vehicles through a travel path defined by the selected motion profiles (e.g., the controller selects a motion profile and plays it to move the support arm via the rapid response actuator).

In some cases, each of the travel paths defines a first angular orientation of the support arm and a second angular orientation of the support arm such that the vehicle on the support arm is moved from a first to a second height during the operating of the actuator. In such cases, at least some of the travel paths defined by the motion profiles may further define a third angular orientation of the support arm such that the vehicle on the support arm is moved from the first to the second to the third height.

In some embodiments, each of the motion profiles defines a different magnitude of angular rotation for a support arm to cause vertical lift of a supported vehicle. In these cases, the selecting of the motion profile for use in the operating of the actuator step may include determining a hub position or an angular orientation of the support arm, comparing the determined hub position or the angular orientation of the support arm with a predefined zone of the ride apparatus, and, based on the comparing, selecting between a base motion profile and an enhanced motion profile providing a larger magnitude of angular orientation of the support arm. Also, in such cases, the selecting of the motion profile for use in the operating of the actuator step may include receiving environmental inputs associated with the vehicle and selecting one of the motion profiles based on a time of receipt of the discrete signal and the received environmental inputs. In these particular cases, the controller may receive, for a particular one of the vehicles, an additional discrete signal from the triggering device in the particular vehicle during movement of the support arm according to the selected motion profile and, in response, select an additional one of the motion profiles and operate the actuator to further move the support arm through an angular rotation defined by the additional motion profile, whereby the angular rotations are additive.

Further, in some embodiments, each of the arms is a multi jointed assembly including at least one joint actuator controlling each of a number of joints within the multi-jointed assembly of the arm. In such embodiments, the motion profile defines a coordinated movement between the joint actuators providing a coordinated movement of each of the joints of the multi jointed assembly of the arm.

According to another aspect of this description, a method is provided for use in a round park ride for controlling a support arm to change heights of a passenger vehicle at an end of the support arm. The method may include, with a controller, receiving a triggering input from a user input device in the passenger vehicle. The method may then include selecting, with the controller, a motion profile defining a motion profile for vertical movement of the support arm about a pivotal mount to a rotation hub of the round park ride. Then, the method may involve generating actuator control signals based on the selected motion profile to move the support arm through the defined motion profile, whereby the passenger vehicle is moved through a plurality of heights free of additional control inputs from the passenger vehicle during the support arm movement.

In this method, the selection of the motion profile may include selecting the motion profile from a set of two or more motion profiles each defining a magnitude of angular rotation of the support arm to move the passenger vehicle from a first height to a second height a predefined distance above the first height. In some embodiments of the method, a step may be provided to receive attraction status data prior to the selecting step. The selecting step may be performed based on processing of the received attraction status, whereby the selected motion profile differs for differing values of the attraction status data. In the method, the attraction status data may include at least one of arm position, hub position, game system input, show system input, and user input from at least one additional input device in the passenger vehicle. Further, the method may include receiving user input from an additional user input device in the passenger vehicle, and, in such embodiments of the method, the selecting of the motion profile may be performed based on processing of the user input from the additional user input device. In some cases of the method, the generating of the actuator control signals may further include modifying the defined motion profile based on received and processed attraction status data.

DETAILED DESCRIPTION

Figure 1:
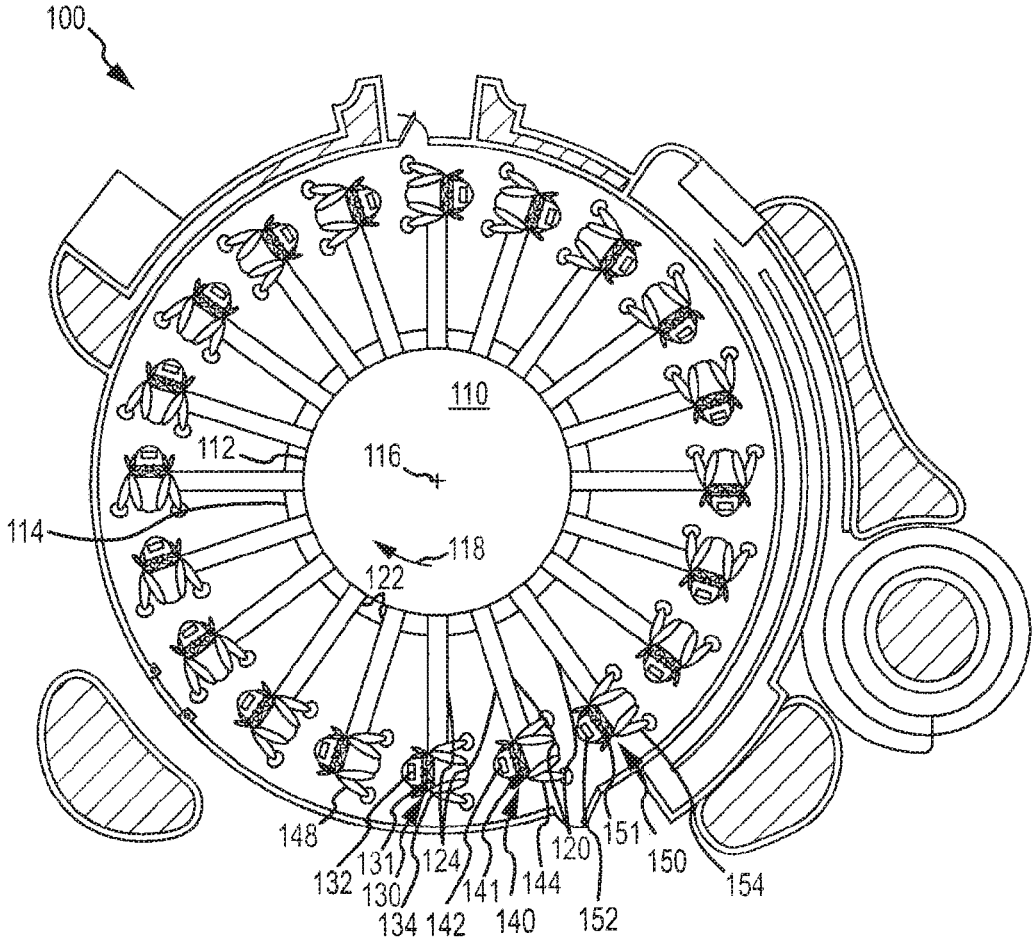
FIG. 1 is a top view of a theme or amusement park ride (or, interchangeably, a park ride, a ride, a round ride, or the like) with multiple support arms extending outward from a centrally located drive and support assembly to support passenger vehicles/cabins.

The description is generally directed to an amusement park ride that provides enhanced passenger or rider interactivity in a round ride. The ride embodiments may be thought of as including a controller that selectively activates an actuation system to independently pivot the multiple arms of the round ride to cause the arms and attached/supported vehicles to follow predefined motion profiles/paths. To provide interaction, one or more passengers in each vehicle may operate input devices to initiate a vertical movement (e.g., provide a jump trigger or trigger a jump signal), and the controller may operate to select one motion profile from a set of stored profiles in memory based on the processing of the user input along with other inputs/data (e.g., timing of trigger, location about rotating hub at time of trigger signal, height of vehicle at time of trigger signal, status of interactive game or show at time of trigger signal, and the like). The actuators for each vehicle typically are high torque, rapid action actuators to, in some embodiments, cause the vehicle to "jump" or to provide quick upward pivoting of the support arm (i.e., the motion profile may be a jump of a particular magnitude to lift the vehicle quickly to a height).

In embodiments where the motion profile involves one or more jumps, a control method and actuation system is provided that is designed to create a high degree of responsiveness such that the arm motion can simulate the vehicle "jumping" into the air to varying heights (a small jump, one or more intermediate jumps, a large jump, and so on in any combination). To this end, the park ride may include a passenger input device(s) that allows a vehicle passenger(s) to initiate or trigger the vertical motion/movement (trigger a next motion profile to start such as to cause a jump). The passenger input device can either be located within the vehicle or outside the vehicle such that a person inside the vehicle can activate the device.

The park ride may also include a processing and control system (or controller, control computer, or the like) that receives the passenger input(s), monitored ride operating information (e.g., present angle of support arm, position of arm/vehicle about the rotating hub or along circle about central axis, and the like), and environmental inputs (such as game status, show status, vehicle status within game, and the like). The processing and control system processes these inputs/data and, based on the processing results, selects a motion profile to playback for the corresponding vehicle.

The park ride further includes an actuator for each support arm, and the processing and control system transmits control signals to the actuator to implement the selected motion profile (e.g., cause the arm and coupled vehicle to move through a motion profile/path corresponding to the motion profile such as to jump vertically upward a preset height such as up to 5 to 30 feet or more). The actuator is preferably able to pivot the arm about its connection point on the rotating central hub relatively quickly, and the actuator is chosen to be able to deliver the force/torque necessary to move the arm along each of the motion profiles stored for the ride (e.g., through any profile that may be selected for the vehicle by the controller).

The ride system described is a multiple-armed round ride that rotates about a center axis. Each arm is connected to the rotating center structure at a pivotable joint that allows for vertical motion to be induced by a dedicated actuator provided in or on the rotating central hub for each arm. The actuation system is designed to have a high degree of responsiveness such that the arm motion can simulate a vehicle jumping into the air and other motion profiles involving vertical movement (e.g., upward and/or downward). Arm motion typically occurs in response to a passenger providing input through either an onboard or offboard trigger device, which replaces the typical analog lever of conventional round rides. In response to a controller receiving the passenger's jump/motion profile trigger, a motion profile (e.g., one of a number of jumps) may be retrieved from memory and initiated through inputs/control signals to the actuator for the corresponding support arm or boom.

The passenger-controlled trigger or input device may be nearly any device that produces a discrete trigger event in response to a passenger action. For example, but not as a limitation, the passenger trigger or input device may be a button, a switch, a touchpad, a slap pad, a stomp pad, a trigger, a wheel, a lever, or the like in or on the vehicle cabin or may be through beam, proximity sensor, or target offboard the vehicle. In addition to the primary trigger device, the characteristics of the jump profile (or which profile is selected by the controller from a set of profiles) may be altered in response to passenger interaction with a secondary input device that is operable to provide either a discrete or a continuous input. For example, a vehicle may have first and second passenger inputs such as in the form of buttons, and the ride controller may process these trigger or input signals received from these buttons to select a motion profile (e.g., select one profile (high jump) if the signals are received within a preset time offset from each other (e.g., substantially simultaneously such as within 1 to 2 seconds of each other) and select other profiles (intermediate, low or no jump or vibration of arm) if outside the preset offset time). In other examples, the height of a jump (e.g., as defined by which motion profile the controller and its software select) may be determined by how fast a passenger-controlled wheel is spinning when the trigger occurs (when the primary input device is operated). In this manner, multiple control elements or user input devices may be operated by passengers of a vehicle to provide the capability for a more immersive passenger/ride interaction and/or the allocation of vehicle control to two or more passengers (not just to one passenger or to one input device). Further, the passenger-initiated motion profile may be coordinated with off-board ride elements to create unique gaming/interactive experiences such as by choosing differing profiles based upon where the vehicle is relative to off-vehicle show/ride elements (e.g., select a different profile if the passenger activates a trigger in a travel zone (jump zone triggering may allow higher jumps)).

The use of two or more motion profiles (in many embodiments) provides a ride experience that differs significantly from conventional multi-arm rotating rides. For example, upon receipt of the trigger input from the vehicle, the controller operates the actuator based on a retrieved or selected motion profile to quickly move the arm upward. In some embodiments, the arm may immediately upon reaching the top of the vertical motion begin to descend, e.g., falling (with or without dampening or actuation) all the way back to the lowest level before another "jump" or other motion profile can be triggered.

The ride systems proposed by this description and accompanying figures may provide several unique ride experiences to passengers. First, the motion profiles and ride control may be configured to provide a basic jump experience. In this embodiment, a vehicle may jump one or more predetermined heights each time the guest triggers the next motion profile to be initiated by operating an input device on their vehicle (e.g., all jumps the same height or randomly selected profiles defining varying heights). Second, the motion profiles and ride control may be configured to provide a timed jump experience. This may be similar to the basic jump except that a different jump is initiated when the trigger input is provided by a passenger at a specific location along the vehicle paths (in the circle about the rotating hub that may be labeled as a jump zone or otherwise identified to passengers on the ride).

Third, the motion profiles and ride control may be configured to provide a progressive jump experience. In these embodiments or modes of ride operation, the height of each jump (or other motion profiled) may be increased each time a jump (or other motion profile) is triggered when the trigger signal is received by the controller within some preset time interval after (or near) the conclusion of the previous jump (or other motion profile/pattern). Fourth, the motion profiles and ride control may be configured to provide a flap jump experience. In this case, a jump (or other motion profile) may be initiated before the conclusion of the previous jump, with each following jump adding onto (or starting from) the elevation/height of the prior jump (or other motion profile). For example, the second jump may be triggered near the peak/maximum of the prior jump which may cause the next jump to reach a second height that is (or is nearly) double a base jump.

While certain examples describe motion profiles described to provide a "jump," "flap jump," and so on, the description is specifically intended to be broad enough to encompass any custom motion profile that a ride designer/creator may generate and use in a ride implementation. Examples of such more complex or custom motion profiles may include a profile used to operate the actuator that causes the vehicle to ascend of its own accord and dropping when the guest/user activates the input device or trigger. This would provide a ride experience akin to guest-induced turbulence when the trigger is activated. Another (or the same) motion profile may provide a neutral position that is high with the motion profile mimicking a dive (e.g., an inverted "jump") when the trigger is activated. This type of profile may facilitate an interactive game played during a ride in which the guests in the vehicles dive their vehicle downward to lower positioned game elements (e.g., to "collect" the game elements and gain game points/increase game state/levels).

FIG. 1 illustrates a ride 100 according to one embodiment for providing an interactive experience to guests or passengers in which they are allowed to initiate playback of one or more motion profiles (such as one, two, three, or more differing jumps or other at least partially actuator-driven arm movements). One of the exciting aspects of the embodiment is that the passenger(s) can affect which motion profile is used to move their vehicle, but other inputs to a controller will also affect the selection of the profile such that the passenger finds the experience more interactive, challenging, and often surprising—which leads to a desire to repeat the experience again and again to try to "win" the ride or to create a different experience.

Generally, as shown from the top view in FIG. 1, the ride 100 is a built upon or provided through use of a multi-arm round ride platform. With this in mind as one useful, but not limiting example, the ride 100 may include a drive and support assembly 110, which may be configured as for a typical round iron ride, e.g., may take the form of one of the drive and support assemblies designed and distributed by Zamperla Inc., 49 Fanny Road, Parsippany, N.J., USA or assemblies provided by other similar ride design and production companies. Often, such an assembly 110 only operates at relatively low speeds such as less than about 20 revolutions per minute (RPM) and more typically less than about 10 RPM such as about 6 RPM in some cases. The control and actuation systems and methods described herein for inclusion in ride 100 for controlling arm actuators in or on assembly 110 to selectively pivot booms or support arms 120 are well suited for use with these low RPM drive assemblies 110 to provide a sensation of jumping or other motion profiles without the need for high centrifugal forces (which may allow passengers to alter movement of their vehicles with weight shifts, manually spinning their vehicles, and so on that are not as relevant to a slowly rotating round ride such as ride 100).

The ride 100 includes the drive and support assembly 110 with a center support structure 112 that is positioned upon a base 114. The support structure 112 houses or supports a plurality of arm actuators (not shown in FIG. 1) for pivoting booms or support arms 120 that are coupled in a pivotal manner at proximal/inner ends 122 to support structure 112 (and that support a passenger vehicle or vehicle cabin at a distal/outer end 124). The support structure 112 is also adapted to drive the ride 100 by rotating as shown with arrow 118 about a center axis 116. The speed at which it rotates may be relatively high such as up to 15 to 20 RPM or more but, in more common applications, the rotation 118 will be less than about 8 to 10 RPM such as about 6 RPM. Also, the rotation 118 may be a constant rate or it may be varied during the course of operating the ride 100. In some cases, the rotation 118 may be in either direction, but, more typically, the ride structure 112 rotates 118 in a single direction, which allows the vehicles to be provided to better simulate forward flight or movement (as may involve jumping along a circular path about center axis 116).

The ride 110 includes a number of support arms 120 that are mounted at a first end 122 to the ride structure 112 and extend outward radially from the axis 116. The arms 120 are shown to be linear with a rectangular cross section but many other configurations may be used to practice the ride 100, such as circular cross section arms with a non-linear shape (e.g., wavy, curved, or the like), and the length of the arms typically is 0 to 30 feet or more. A main function of the support arms 120 is to provide a rigid or relatively rigid connection between the ride structure 112 and a set of vehicles (such as vehicles 130, 140, 150 and the others shown in FIG. 1).

The arms 120 are pivotally mounted at ends 122 such that the angle of the arm 120 relative to the base 114 and/or the ground may be changed by actuators in drive and support assembly 110 during the ride, e.g., in response to control signals from a controller or ride control system that correspond to a motion profile selected in part based on user input. To this end, the vehicles 130, 140, 150 are each shown to include a body or cabin 134, 144, 154 in which one, two, or more passengers 131, 141, 151 may be seated or supported. Each vehicle 130, 140, 150 also includes a user input or profile ("jump") trigger device 132, 142, 152, and the passengers 131, 141, 151 may operate these devices 132, 142, 152 to transmit a profile triggering signal to a ride controller or control system, which processes these signals along with other monitored information such as arm position, vehicle position, and ride/show status (or other environmental information) to select a particular motion profile from a set of possible motion profiles from controller memory/data storage. With the selected motion profile, the controller functions to generate actuator control signals for the arm 120 in response to the trigger signals from a passenger 131, 141, 151 which causes the arm 120 to pivot about end 122 (typically vertically upward through a preset angular rotation such as a few degrees (for a small jump) to many degrees (such as 15 to 60 degrees or more) for a larger jump or upward lifting movement), which causes the height of the vehicles 130, 140, 150 to be quickly changed.

Figure 2:
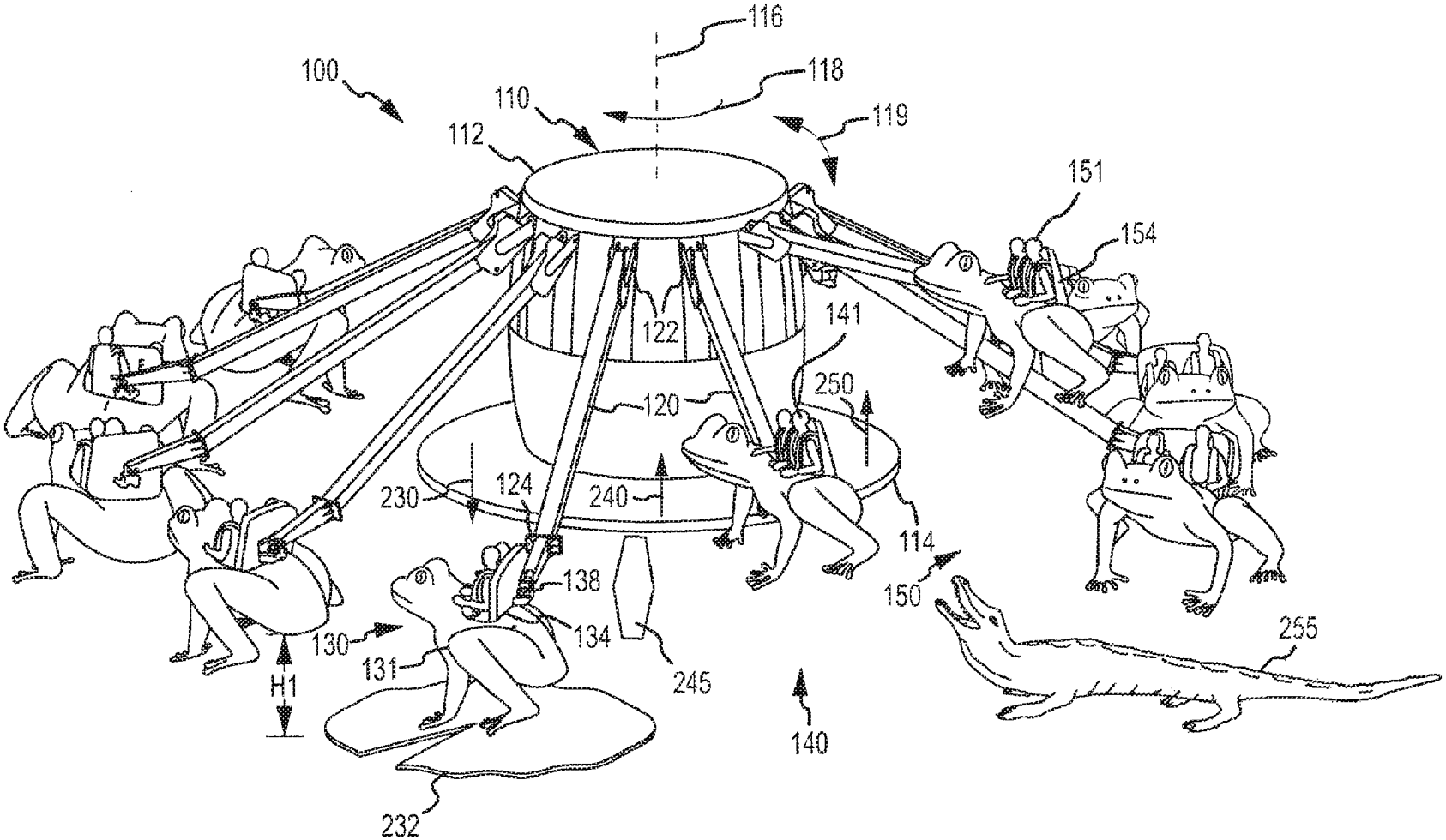
FIG. 2 is a perspective view of the park ride of FIG. 1 (or, more simply, park ride) configured according to an embodiment described herein and showing operations of the drive and support assembly to move the vehicles according to passenger-initiated motion profiles (e.g., rapid upward vertical impulses or jumps of differing magnitudes based on concurrent processing of passenger input/triggers and ride and/or environmental inputs)
Figure 3:
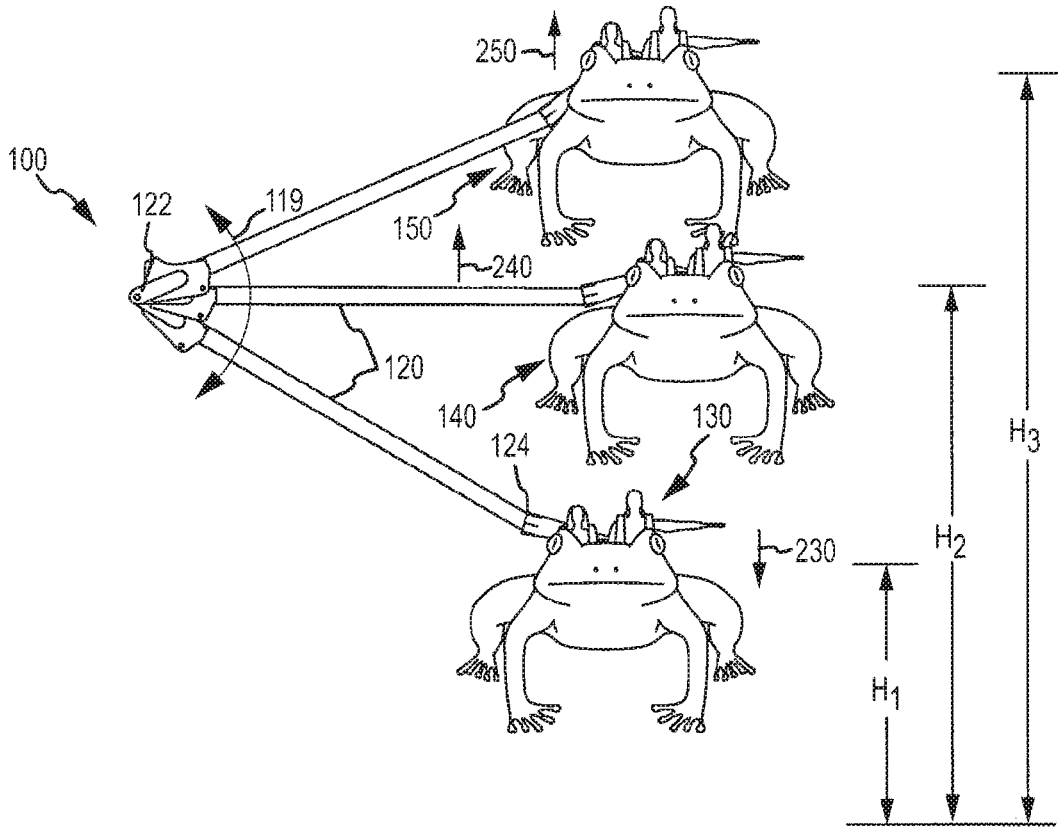
FIG. 3 illustrates a partial side view of an operating park ride illustrating operational modes or positions for the vehicles and drive and support assembly including loading (and/or landing/lowest vehicle height), an intermediate position or height, and a highest operating position.

FIGS. 2 and 3 illustrate the ride 100 in perspective view and in a partial side view to better explain operations of the ride 100 to provide unique movements of the vehicles 130, 140, 150 using passenger-initiated motion profiles. During operation of the ride 100, a passenger 131, 141, 151 may operate a trigger device 132, 142, 152 to trigger or initiate movement of their vehicle cabin 132, 142, 152. However, they do not completely control its vertical movement (such as with an analog joystick) as they only initiate or trigger a profile to be played back by the controller. Further, the controller is responsible for selecting the motion profile from a number of possible profiles (in some embodiments) such that the passenger 131, 141, 151 does not have full control over movement of their vehicle cabin 132, 142, 152 in ride 100.

The motion profile may cause vehicle cabin 132, 142, 152 to move vertically upward and then fall back downward (e.g., to "jump" a particular height) or move through a more complex motion pattern (e.g., upward a particular amount, downward for a time period, upward the same or a differing amount, and so on). Hence, the term "motion profile" is not limited to a simple vertical jump but may involve downward movement of the arm as well as two, three, or more actuations of the arms 120 to move the vehicle cabins 132, 142, 152 along numerous paths to suit a particular ride/show/game design. Many of the examples provided describe "jumps" as defined by motion profiles, but this is more for ease of explanation as the description clearly is not limited to such simplistic motion profiles being triggered or initiated by a combination of passenger input (or inputs from two or more passengers) and, typically, monitored ride status (e.g., arm location, vehicle height/location, and so on) and environmental inputs (show or game status, vehicle or its passengers' game status such as number of points obtained thus far in ride being used to select a motion profile, and so on).

As shown, the vehicle 130 is at (or falling to/approaching 230) a first height, $H_1$, that may coincide with a loading height or, more typically, a lowest rotation height for the ride 100 (e.g., the arms 120 may be raised in platform 112 after loading to raise the vehicles 130, 140, 150 to the first height, $H_1$, above the loading platform (not shown)). The ride 100 may be configured such that passengers 131, 141, 151 are encouraged, such as through the awarding of points or the like in an interactive game, to fall onto or jump onto landing zones or pads. The successful landing may be reaching 230 the lower height, $H_1$, within an portion of the circular path about the axis 116 coinciding with a demarcated landing area, such as a lily pad when the cabins 134, 144, 154 are designed as frogs or other jumping creatures and the ride 100 has a swamp/water theme. Of course, the cabins 134, 144, 154 will be a predefined distance above the ground/pads 232 at the lower or base height, $H_1$, to avoid a passenger 131, 141, 151 touching a structural aspect of ride 100.

The lowering 230 of the arm 120 supporting cabin 134 may be initiated by the passengers 131 via use of input device 132 in some cases (e.g., initiate a lowering motion profile), but, in other embodiments, landing/falling 230 has to be timed by triggering a jump/lift vertically upward such that the jump or other motion profile (shown at 240 and 250) ends or is terminated over the landing zone 232. The landing zone 232 may also be used as a jump/motion profile trigger zone with different profiles (larger jumps, for example) or motion profile modifiers (such as a multiplier for a jump to increase its magnitude) being chose by a controller when a passenger 131 triggers a next motion profile when the vehicle 130 is traveling over the landing/jump trigger zone 232. If the vehicle 130 is not over the pad/zone 232, a different motion profile (or modifier/multiplier) may be selected such as to perform a smaller jump, to cause the arm 120 to vibrate or move more sluggishly/slowly upward, or the like to provide instant feedback to the passengers 131 that they mistimed their triggering/input.

The vehicle 140 is shown at a second height, $H_2$, that may result from the arm 120 supporting vehicle 140 pivoting 119 upward rapidly from the first height, $H_1$. This may be the result of a controller selecting and playing back a motion profile in response to the user operating a trigger device 142 and ride/environmental information. For example, the ride 100 may be configured to encourage the passengers 141 to trigger the input device 142 to cause their vehicle cabin 144 to pass through a point zone marked to coincide with a range of heights including the second height, $H_2$.

When the vehicle cabin 144 times their triggering to cause a jump 240 to put the vehicle 140 at the second height when the arm 120 passes through the point zone 245 portion of the circular path about center axis 116, the controller (not shown) may act to change environmental data such as increasing the points associated with the vehicle 140 or take other actions such as to modify the motion profile associated with lift/jump 240 (e.g., give the vehicle 140 a boost upward by rotating 119 the arm 120 an additional amount such as an addition 5 to 10 degrees or more). When points are increased (e.g., ride or game status for the vehicle), this data may be used the next (or a later) time that the trigger device 142 is operated to modify a motion profile (apply a multiplier of 1 to 2 or more to the profile to increase the magnitude of the rotation 119 of the arm 120) or to alter which profile is selected from memory for playback (e.g., only allow bigger jumps 250 when a certain point level is reached, a number of moves have been performed by the vehicle 140, and so on).

The second height, $H_2$, may be considered, in some cases, an intermediary or lower height reached when the arm 120 follows a base or unmodified motion profile (e.g., a small jump or the like), e.g., 10 to 20 feet above the first height, $H_1$, or the like when the third height, $H_3$, is 15 to 30 feet above the first height, $H_1$. In other words, the heights, $H_2$ and $H_3$, may be peak/maximum heights associated with two motion profiles (such as two differing magnitude jumps) with the upward lift 240, 250 being nearly completed in the illustrated ride 100. Likewise, the first height, $H_1$, may be the end or termination point of a motion profile (a jump), with downward motion 230 being nearly completed for the arm 120.

The ride 100 is further operating to move 250 the arm 120 supporting vehicle 150 to a third height, $H_3$, that is greater than the second height, $H_2$. This may be the result of the controller selecting a motion profile that differs from the one used to cause movement 240 of arm 120 supporting vehicle 140. For example, the vehicle 150 may have a different game/ride status stored in memory that causes the controller (or its profile selection software/code) to select a motion profile lifting the vehicle 150 a greater amount. In another example, as shown, the profile causing the lift 250 to the third height, $H_3$, is chosen in part because the triggering by the passengers 151 operating the input device 152 occurred proximate to the obstacle/game feature 255 (e.g., an attacking animal/creature such as an alligator when the vehicle cabin 154 is shaped as a frog or the like).

Hence, the controller chooses the motion profile not just based upon receipt of the trigger signal from the passenger 151 but also based on the location of the vehicle 150 (or arm 120) relative to the circular ride path defined about the center or rotation axis 116 for the hub structure 112. For example, one motion profile may be chosen when the vehicle is at a first location (within a predefined range about 90 degrees rotation that is associated with jump pad 232) and another profile when the vehicle is at a second location (within a predefined range about 0 degrees rotation that is associated with the ride obstacle/game feature 255). The profile selection may also take into account vehicle or game status (or other environmental data) in combination with vehicle position (and/or vehicle height) such that differing profiles are chosen based on such environmental data or the selected profile is modified by the controller prior to issuing actuator control signals. For example, a base jump profile may be selected based on vehicle location but when a game status is above a certain level an intermediary jump or a large jump profile may be selected instead.

As can be appreciated, the variability of the selection of the motion profiles increases interactivity with the ride that each passenger 131, 141, 151 experiences during operation of the ride 100 and can make each ride taken by the passengers different and unique. Also, the above examples make it clear that the passengers' operation of the input devices 132, 142, 152 does not provide complete control over movement of the vehicles but instead initiates playback of a motion profile in which the controller and actuators take over control over the movement of the vehicles.

Figure 4:
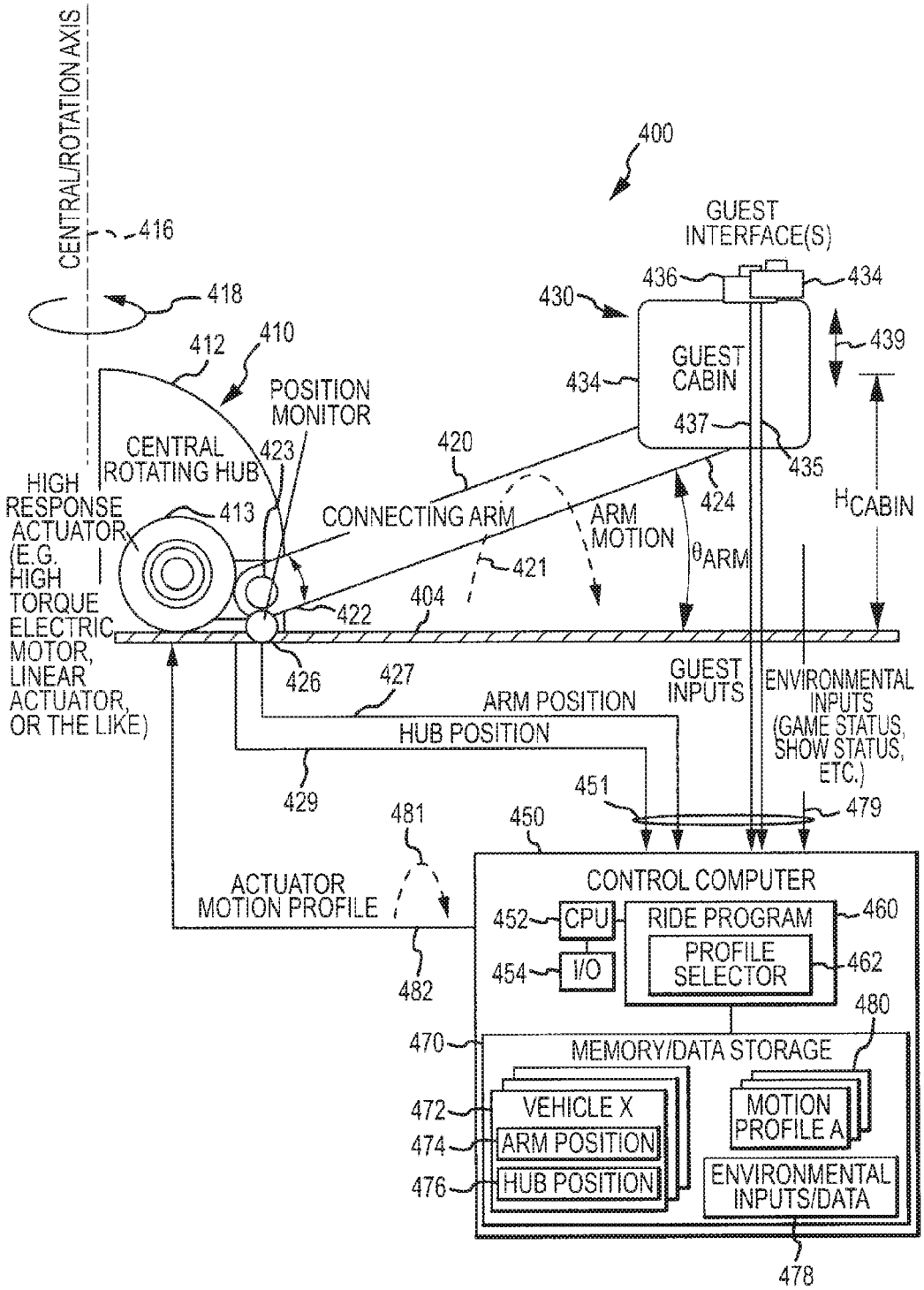
FIG. 4 illustrates schematically a ride of an embodiment described herein showing use of a controller to process a plurality of inputs (input signals/data including passenger inputs from the vehicle cabin) to select one motion profile from a number of such profiles, with the selected motion profile defining movement of a connecting arm and/or actuator control signals/operation.

FIG. 4 illustrates schematically a park ride 400 in which passenger-initiated motion profiles are used to control movement and/or positioning of vehicles on a round ride platform. The ride 400 includes a drive and support assembly 410 on the platform or ground 404, and the assembly 410 includes a central rotating hub 412 that rotates 418 about its central/rotation axis 416. The ride 400 may be a multi-arm round ride with FIG. 4 showing one exemplary vehicle 430 that includes a passenger cabin 434 attached to an end 424 of a support or connecting arm 420. The arm 420 is supported at the other end 422 by the central rotating hub 412, and, specifically, a pivotal joint 423 is used to support the arm 420. The assembly 410 further includes a response actuator 412 (such as, but not necessarily, a high response actuator sized to meet the specific performance criteria defined by the ride experience) for pivoting arm 420 about connection/joint 423. The actuator 412 is "high response" in the sense that it is selected to be able to rapidly rotate the arm 420 through a range of orientation angles, $\theta_{Arm}$, relative to the ground/platform 404. This rotation causes the cabin 434 to be moved quickly vertically through a range of cabin heights, $H_{Cabin}$, again measured from the platform/ground 404 (e.g., "high response" may be such that the cabin 434 can be moved from 0 to 10 feet or more in height, $H_{Cabin}$, in less than 1 second). A wide variety of high response actuators may be used for actuator 413 such as a high torque electric motor, a linear actuator, a hydraulic actuator, or the like.

In the ride 400, the actuator 413 is operated by control signals defined by an actuator motion profile 482 transmitted by a control computer 450. The actuator motion profile/control signals 482 define a pattern or arm profile 481 that is translated to arm 420 as shown by arrow 421 through selective operation of the actuator 413 to pivot the arm 420 about pivotal joint 423. A significant aspect of the ride 400 is the manner in which the actuator motion profile 482 is generated by control computer 450. The profile 482 is not simply a one-to-one movement of the arm 420 in response to movement of a controller (such as a joystick or valve control) in the cabin 434 but is instead one, two, or more actuation signals predefined by a motion profile 480 stored in system memory 470 that is chosen by the control computer 450 based on a number of inputs 451.

With this in mind, the ride 400 includes the control computer (or computer system(s)) 450 that provides one or more hardware processors 452 that are operable to execute code or run software programs to perform particular functions such as selecting one of the motion profiles 480 to generate actuator control signals 482. The control computer 452 may include input/output devices 454 (whose operation may be controlled/managed by processor 452) such as keyboards, a mouse, a touchscreen/touchpad, and the like to allow an operator to input commands and also wired or wireless devices for receiving inputs 451 including passenger inputs 435, 437 and for transmitting data such as actuator motion profile 482 to high response actuator 413.

The processor 452 may execute or run a ride program 460 (code or code devices provided in non-transient computer readable medium or the like that cause a computer to provide particular steps/functions). The ride program 460 may function to control operation of the actuator 413 as well as other parts of the ride 400 such as controlling rotation 418 of hub 412. The ride program 460 may also monitor, process, and store environmental inputs (as shown at 478 in memory 470) such as game status for each vehicle 430, show status (e.g., what is occurring in a show that may affect generation of motion profile 482 and the like), and other monitored data. The ride program 460 may also receive and store for each vehicle 430 a record 472 that stores the angular position 474 of the arm 420 based on a signal 427 from a position monitor/sensor 426 in hub 412 (e.g., process this signal to determine vehicle height which may be stored at 474 instead of angle, $\theta_{Arm}$).

The ride program 460 further may include a subroutine/program such as a profile selector 462 that functions to process the variety of inputs 451 to determine which of two or more motion profiles 480 should be selected for creating the control signals/profile 482. Often, the selection will be based on more than one of these inputs 451 considered concurrently or the inputs such as hub position 429 (e.g., position of vehicle 430 about the circular path defined about periphery of the central/rotation axis 416) or environmental inputs 479 may be used to modify the chosen profile to affect the transmitted signals 482 (e.g., increase/decrease the magnitude of the profile 481 or the like). The hub position signal/data 429 may be received from a sensor on the rotating hub 412 while the environmental inputs 479 may be received from the cabin 434 and/or from off-board gaming/show controls (e.g., devices used to score performance of the passengers/vehicle 430, devices playing/controlling a show in which the ride 400 is provided, and so on).

To initiate a motion profile selection and playback, the passenger cabin 434 is shown to include two (or more) passenger interfaces 434, 436. One 434 may be a trigger device such as a button, switch, or touch/stomp pad or the like to provide a discrete (on/off) signal 435 as a trigger input/signal to the control computer 450. The other 436 may also be a similar trigger device used to create signal 437, and the computer 452 may use the profile selector 462 to determine if the two (or more) inputs 435, 437 are received within a predefined time period (e.g., both receiving with a 1 to 2 second window), and, if so, to select a profile 480 defining a first movement 421 of arm 420 but, if not so, to select a different profile 480 defining a second movement 421 (such as a smaller jump if not well timed triggering of buttons 434, 436). In other cases, the second (or more) input devices 436 provide a continuous or range of values input 437 such as by spinning a wheel with the speed it is being spun when the trigger 434 is operated defining for selector 462 which profile 480 is chosen for playback 482 or the like. In this manner, cooperative interaction by the passengers in vehicle 430 may be required to achieve a desired arm movement 421 or to reach a desired cabin height, $H_{Cabin}$.

Figure 5:
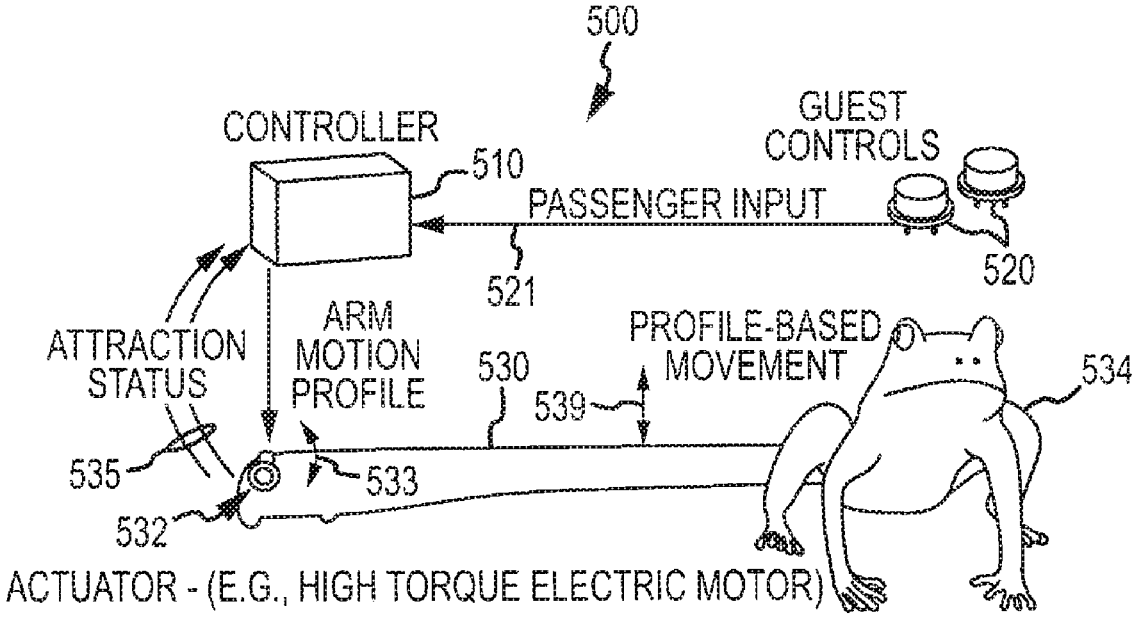
FIG. 5 provides an additional schematic representation of a round ride according to the description in which controller-selected arm motion profiles are used to control movement (via an arm actuator) movement of a support arm.

FIG. 5 provides a simplified schematic showing a portion of a park ride 500 according to an embodiment of the invention. As shown, the ride 500 includes a controller 510 that receives passenger input 521 from two or more passenger controls 520, which typically would be associated with a particular vehicle 534 (shown to be a jumping animal such as a frog). The controller 510 also receives attraction status information 535 such as from sensors/monitors positioned in or associated with the central rotating hub and its components. A boom or arm 530 is provided to support the vehicle 534 and an actuator 532 is used to pivot (or vertically position) 533 the arm 530 to provide profile-based movement 539. One option for the actuator 532 is a high torque electric motor (as shown) while another useful, but not limiting, option is to use a linear actuator.

The status information 535 may be the angular position of the arm 530, the position of the arm 530 and attached vehicle 534 relative to the circular path about the axis of the central hub (e.g., where in the 360 degree path about the axis is the arm 530 and supported vehicle 534?), and other environmental information such as the ride/game status of the vehicle 534 (e.g., how many points have they earned?, which game level are they on?, which tasks/jumps/tricks have they performed?, and so on) or ride/show state (e.g., could select differing profiles based on the same passenger input 521 at differing times of a show/ride such as to build excitement with higher and higher jumps as the ride progresses or with more and more erratic movement 539 of arm 530 and so on).

During operation of the ride 500, the controller 510 processes the passenger input 521 and the received attraction status information 535 to select a motion profile that may be stored in memory accessible by controller 510. The controller 510 then uses this profile to generate control signals 537 (with some cases simply involving a playback of retrieved motion profile that may comprise a set of actuator control signals for actuator 532), and the actuator 532 responds by pivoting 533 the arm 530 to create the profile-based movement 539 in the arm 530 and coupled vehicle 534.

Figure 6:
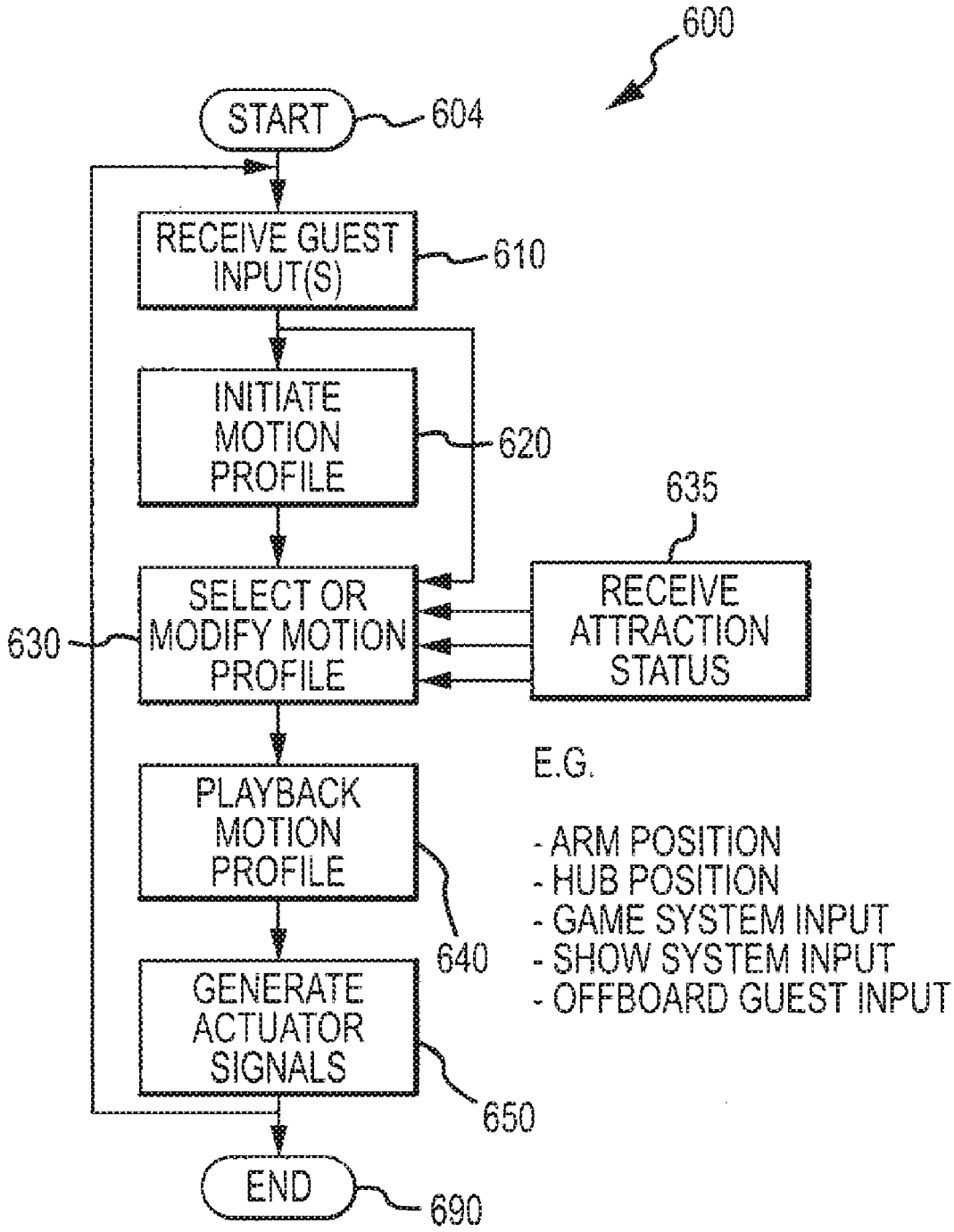
FIG. 6 is a flow diagram for a method of operating a round ride to provide an interactive rider experience by allowing the user to affect selection of a motion profile.

FIG. 6 illustrates a method 600 of controlling operation of a round ride (such as rides 100, 400, 500) to provide enhanced passenger interactivity and a new ride experience. The method 600 starts at 604 such as by generating a number of motion profiles and storing these in memory (code, applications, computer programs, and the like stored in computer readable, non-transient medium configured to cause a computer such as via its hardware processor to perform particular functions) that is accessible by an actuator control device. For example, the profiles may define two, three, or more jump profiles (e.g., pivot arm through a particular angular movement in a predefined time period to change cause the attached vehicle to "jump" to a particular height and then letting the arm/vehicle "fall" back to the starting height/angular arm orientation).

At 610, the method 600 continues with receiving one or more passenger inputs 610 at the actuator control device. Typically, step 610 occurs when one, two, or more passenger input devices on a vehicle are operated by passengers of the vehicle. At 620, the method 600 continues initiating motion profile selection with a profile selector program. This initiation may cause attraction status to be retrieved/received at 635. The attraction status may be an arm position (angular position relative to a reference plane such as one passing through the base of the hub or the like), a hub position (e.g., amount of rotation of the hub relative to a starting point and its central axis), game system input (e.g., status of vehicle or its passengers in a game, presently displayed game elements proximate to the vehicle, and so on), show system input (e.g., stage of show relative to a ride and its vehicles), and, in some cases, off-board passenger input (e.g., the motion profile selection may be affected by interaction with input devices by people not riding in the vehicles so that these people may alter which profiles are played back).

At 630, the actuator controller acts to select and/or modify a selected motion profile. For example, the arm and hub position at the time of receipt of the passenger input/triggering signals at 610 may cause the controller to select a particular motion profile while the game system input or other attraction status information may be used by the controller to modify this selected motion profile (e.g., to make a selected jump have a smaller or larger magnitude or shorter or longer cycle time from start to end, and so on). At 640, the controller acts to playback the selected (and, in some cases, modified) motion profile. The played-back profile may include or the actuator signals may be generated separately but at 650 the actuator signals are generated and/or transmitted to the actuator to cause the boom or support arm to pivot in a pattern (and a rate) defined by the selected (and optionally modified) motion profile. The method 600 may continue with receiving additional passenger inputs at 610 or end at 690 (such as when a ride is ended based on show system input received at 635).

As discussed above, the motion profile may define a relatively complex pivoting pattern carried out by an actuator to move a support arm/boom through a movement pattern/profile. For example, the vehicle may be moved through a sinusoidal pattern with several similar or different peaks and valleys and with the same or differing durations. The motion profile may also include vibration, quick rises and drops, and other movements of the arm and attached vehicle to suit a ride/game design. However, at this time, it may be useful to explain use of motion profiles initiated by passengers via use of input devices in vehicles in the context of several jumping implementations. In these implementations, the actuator is typically triggered to rapidly pivot the arm upward to a particular height (maximum height or peak height of the jump), and, then, the arm is allowed to fall under the force of gravity (with assistance or with dampening in some cases).

Figure 7:
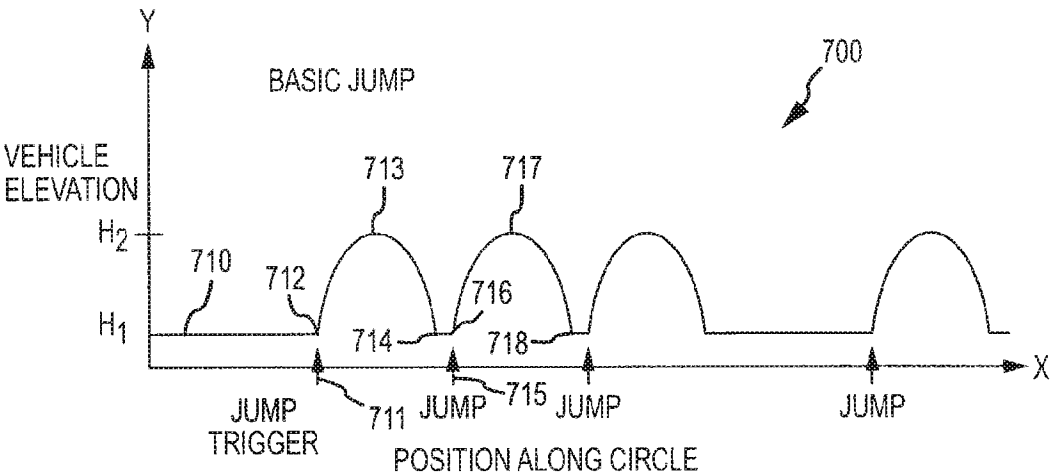
FIGS. 7-10 are graphs illustrating operation of a vehicle to create a number of ride experiences with motion profiles selected to create differing jump (vertical impulse) effects based on user input and other data (such as position of vehicle/arm about circle or periphery of central, rotating hub and such as timing of user input/entering of jump trigger).

FIG. 7 shows a graph 700 of vehicle elevation versus position of a vehicle along a circular path about a rotation axis of a rotating support hub in a round ride. Line 710 illustrates the height of the vehicle during the ride along the circular ride path. The graph 700 is used to illustrate a basic jumping implementation for controlling a round ride based on rider triggering of motion profiles. In this embodiment, a single motion profile is used that defines a jump of a particular height (i.e., to a second height, $H_2$, from a first or base height, $H_1$). Each time a passenger activates the input or trigger device playback of the motion profile is performed by the actuator control system, and this causes the arm to be pivoted upward such that the vehicle rises to a predetermined elevation and then drops back to a lower or base level. In this embodiment, the passenger may only be allowed by controller to trigger the next jump from the base or first height, $H_1$, such that the ride program run by the controller acts to receive a trigger signal and to determine the present height of the vehicle and when it is not equal to the first height, $H_1$, to ignore the triggering signal.

As shown with line 710 of graph 700, the basic jump control may include a passenger operating the trigger at 711 (issue a jump trigger signal or the like at this position along the circle). The height of the vehicle changes from the base/first level, $H_1$, at 712 to the peak or maximum jump height at position 713 along the circle and then falls down to base/first height, $H_1$, at 714. The passenger may initiate an additional jump trigger 715 at position 716 (any time after position 714 when the vehicle has reached the first/base height, $H_1$). The controller again plays back the motion profile to cause the actuator to operate to pivot the arm upward rapidly to move the vehicle to the peak or second height, $H_2$, at position 717 along the ride's circular path. Again, the arm is allowed to drop or fall to the first/base height, $H_1$, at position 718 along the circular path.

Interactivity may be increased by providing ride or show elements to encourage the timing of the jumps. For example, the vehicle may jump to "catch" or "hit" an object such as projected or real flies when the vehicle is a frog or lizard. The ride may include control/monitoring devices that determine when the vehicle has properly timed their jumps to award them points in the game (or otherwise provide positive feedback to the passengers or to provide negative feedback such as by vibrating the arm when jumps are mistimed). The vehicle may also be encouraged by show/game elements to avoid particular show/ride/game features such as objects projected into their path or an alligator or other attacking creature on the circular path below the vehicle. In other cases, the ride may involve trying to jump from object to object such as from lily pad to lily pad by timing the triggers 711, 715, with points (or motion profile modifications) awarded for successfully timing jumps.

Figure 8:
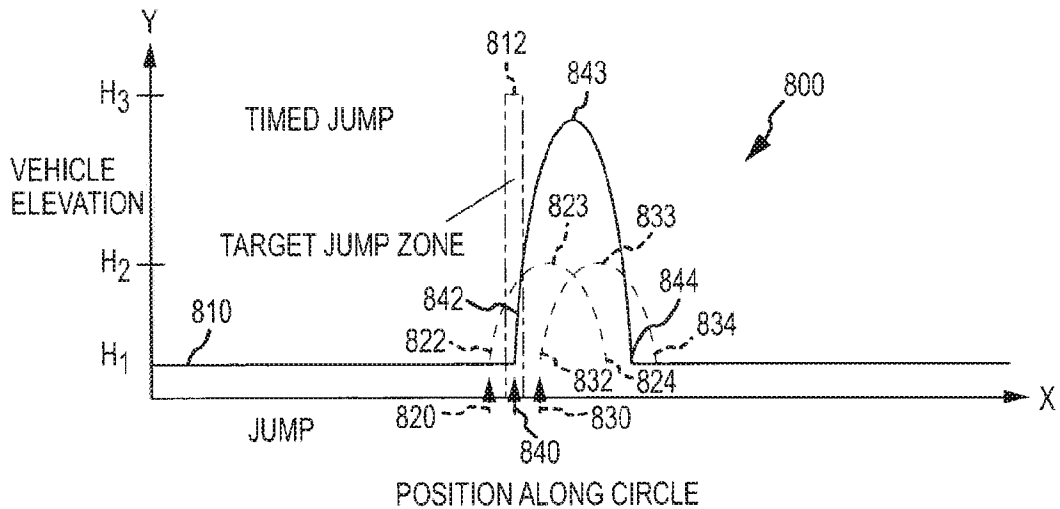

FIG. 8 illustrates a graph 800 of a timed jump mode of actuator control showing vehicle height relative to position of the vehicle along the ride's circular path with line 810. The vehicle is at a first or base height as the ride begins and the arm is used to move the vehicle along the circular ride path. In this mode of control, the controller selects one of two motion profiles (e.g., a small jump or a large jump profile). Each time a passenger activates a profile or jump in this example, the vehicle is lifted to a predetermined elevation or height by actuation of the actuator associated with the vehicle's support arm. Once the peak of the jump profile is reached, the actuator allows the arm to fall back downward to its original angular orientation (e.g., allows the vehicle to fall to the first or base height).

The game/interaction is a timed jump, and, in this regard, if the passenger activates the jump in the target jump zone (or launch pad area) of the circular path, the controller selects the large or super jump profile with a higher magnitude peak or maximum height. If not within this target jump zone, the controller chooses the base or small jump profile. Typically, passengers can only trigger jumps when the vehicle is at the base or first height (shown as $H_1$ in FIG. 8) and other trigger signals are ignored by the controller (or its profile selection software).

The target jump zone may be at a fixed portion or length of the circular path such that the vehicles pass over and over it during the ride allowing the passengers to better get used to the location to time their triggering inputs on the input devices of their vehicles. In other cases, though, the target jump zone may be moved during the ride such that it is a moving target (or blinking/disappearing and reappearing target) so as to increase the difficulty for the passengers in properly timing the input of the trigger signals to the controller (e.g., have the jump zone move back and forth traverse to the circular path or have the jump zone move in the same or opposite direction as the vehicles along the circular path at the same or differing speeds). In these implementations, the controller monitors/receiving environmental inputs that include the present location of the target jump zone so that it can compare a received location/position of the vehicle on the circular, ride path with the moving target jump zone to find adequate overlap (e.g., any part of vehicle over zone or require some percentage overlap or require a part of the vehicle (e.g., its "legs" or the like responsible for jumping) to be over the zone) to determine it is proper to award the super jump motion profile to a vehicle.

The timed jump mode of actuator control is shown in FIG. 8 with a target jump zone 812 coinciding with a range of positions along the circular ride path. When a passenger initiates an early trigger 820 before the zone 812 at 822, the controller selects the small or base jump motion profile for playback. The controller transmits control signals to the actuator that cause it to pivot the arm upward so as to move the vehicle to a peak or maximum height, $H_2$ (such as 5 to 15 feet or the like over the base or first height, $H_1$) and then drop it back down at 824 to the first height, $H_1$. Likewise, when the passenger triggers 830 the motion profile too late or outside/after the jump zone 812 at 832, the controller selects the small or base jump motion profile for playback. This includes signaling the actuator to pivot the support arm upward to move the vehicle to the peak elevation associated with the second/intermediary height, $H_2$, and then to allow the arm to drop to move the vehicle back to the first height, $H_1$, at 834.

However, when the passenger initiates the trigger 840 within the target jump zone 812 portion of the circular ride path at 842, the controller selects the super jump motion profile and the arm is rotated through a greater angular rotation to move the vehicle to a third or higher peak elevation, $H_3$. This may be up to twice or more the second height, $H_2$ (such as 10 to 30 feet over the first/base height, $H_1$). The arm is then allowed by the actuator to fall back downward to move the vehicle back to the first or base height, $H_1$, at which point the passenger may trigger another jump or motion profile.

Figure 9:
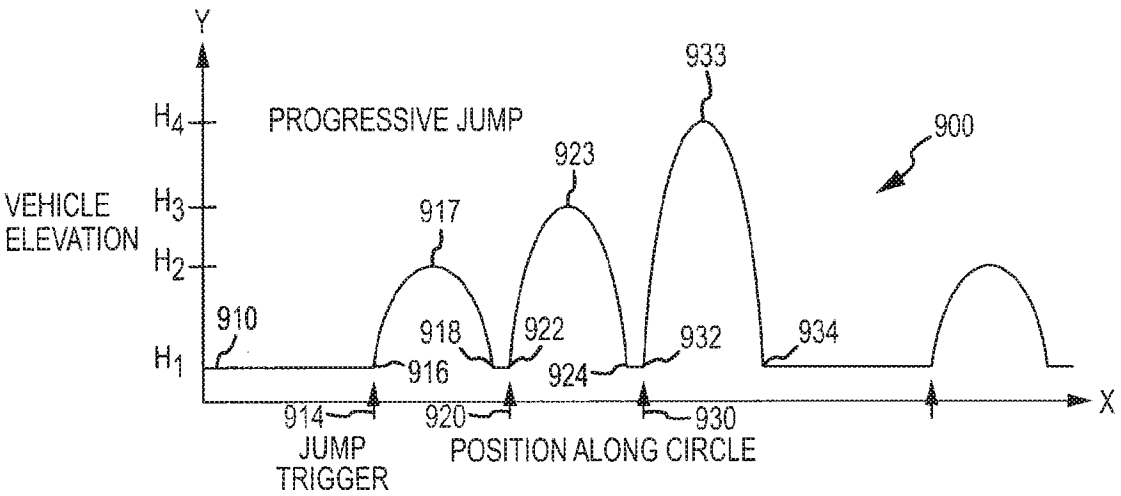

FIG. 9 illustrates a graph 900 of another actuator control mode that may be labeled a progressive jump, and, in the graph 900, the vehicle height relative to the vehicle's position along the circular ride path is shown with link 910. Again, the first or base height is shown as $H_1$ for the vehicle. In this control mode, the first time a passenger triggers 914 or activates a jump (or other motion profile), the controller selects a first motion profile defining a relatively small jump. When this profile is used by the controller to issue actuation control signals, the vehicle is raised by the arm to a predetermined elevation, $H_{21}$ at location 917 along the ride path and then drops back down to the lower, first level, $H_1$, at 918 along the circular ride path.

If the passenger activates 920 a next jump shortly after "landing," the new, next jump is higher than the previous jump (e.g., jump, Jump, and then JUMP). In this case, the passenger can only trigger a jump from the lowest or first level, $H_1$. So, as shown, the position 922 coinciding with the second trigger 920 is determined to be within an acceptable distance from or range along the circular ride path from the landing point 918 by the profile selector of the actuator controller, and the selector then retrieves a motion profile defining a next larger jump. Then, playback causes the jump to begin at 922, to reach a second higher peak at 928 associated with a third height, $H_3$, greater than the second height, $H_2$, and then at 924 to land back on the lower or first elevation, $H_1$. If the passenger again triggers 930 a next jump at 932 that is determined to be within an allowable distance from landing point 924, the controller acts to select the next larger or progressive motion profile to define an even larger jump. This is seen in graph 900 as the vehicle is raised at 933 to a fourth, higher height, $H_1$, and then dropped back down to the first, base height, $H_1$, at 934 along the ride path. If this is the highest jump, the next jump may repeat this high jump or return to the smallest jump. If the next jump is triggered outside the acceptable progression zone (as shown), the next jump may be the original or smallest jump to peak at the second height, $H_2$.

Figure 10:
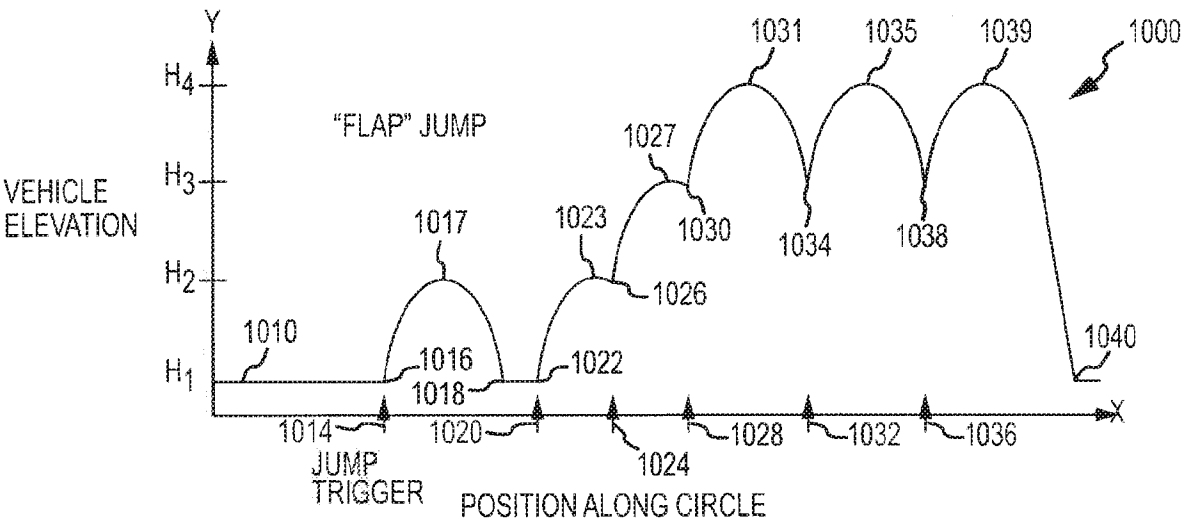

FIG. 10 illustrates yet another exemplary control mode for an actuator with graph 1000. This control mode may be labeled a "flap" jump mode as a next jump (or other motion profile) may be triggered prior to the previous profile/movement being completed such that the vehicle can be stepped up or flapped upward in height (or in increased/magnified arm movements). As shown, the line 1010 represents the vehicle height relative to the vehicle's position along the circular ride path. The vehicle begins at a base or first height, $H_1$, and each time a passenger activates or triggers a jump, the vehicle rises a predetermined amount and then starts to drop back towards the low or first level, $H_1$.

This can be seen with graph 1000 as the passenger issues a jump trigger 1014 at vehicle position 1016 that the controller responds to by playing back a motion profile that lifts the vehicle, by actuating the actuator associated with the support arm coupled to the passenger's vehicle to pivot the arm a set amount, to a second height, $H_2$, at path position 1017 and then drops the vehicle back down to the first height, $H_1$, at position 1018 along the ride path. Hence, the passenger can affect simple isolated jumps by allowing the vehicle to drop all the way down to this first elevation, H1.

However, the passenger can trigger additional jumps while a preceding jump (or motion profiled is still proceeding. For example, the passenger at vehicle position 1022 may trigger 1020 a next jump, and the controller may retrieve the motion profile defining the jump (e.g., an additional amount of pivoting of the support arm within a certain timeframe such as 15 to 30 degrees in 1 to 2 seconds or the like). This profile is used to issue control signals to cause the vehicle to be lifted by rotation of the arm to a second height, $H_2$, at path position

1023. Now, if the passenger triggers 1024 a next jump at a vehicle position 1016 before the vehicle drops to the first elevation, $H_1$, the vehicle is forced to rise to a third height, $H_3$, at path position 1027.

As seen, the motion profile is triggered again (repeated) such that the vehicle rises a delta amount above the current vehicle position (e.g., the difference between the second height, $H_2$, and the first height, $H_1$), which causes the average vehicle elevation to increase. Triggering can continue in this flapping manner as shown at triggers 1028, 1032, 1036 associated with vehicle positions 1030, 1034, 1038, respectively, along the path to cause the vehicle to jump further up to a fourth height, $H_4$ (or more heights until some maximum arm rotation point is reached). When an additional trigger is not received, the vehicle returns at 1040 to the first or base elevation, $H_1$. In other words, in this actuator control mode, elevation may be maintained by regular pulsing of the jump control/triggers (e.g., similar to a bird periodically flapping its wings), and the passenger is allowed to trigger the playback of the single motion profile at any time during and any elevation.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A ride apparatus for allowing passengers to initiate vehicle movements, comprising:

a drive assembly including a structure rotatable about a central axis at one or more rotation speeds, the drive assembly further including a plurality of support arms extending outward from the structure;

a plurality of passenger vehicles each mounted proximate to an end of one of the support arms distal to the drive assembly, one or more triggering devices associated with each of the vehicles generating a discrete signal when activated by a passenger of a vehicle, wherein each of the support arms is pivotally mounted to the structure for angular rotation by an actuator to change a height of the corresponding vehicle; and a controller in communication with the actuators and the triggering devices, the controller receiving the discrete signals from the triggering devices, selecting a motion profile based on each of the received discrete signals, and operating the actuators based on the selected motion profiles to move the vehicles associated with the discrete signals through a travel path defined by a particular one of the selected motion profiles, wherein each of the motion profiles defines a different magnitude of angular rotation for a support arm to cause vertical lift of a supported vehicle, and wherein the selecting of the motion profile for use in the operating of the actuator step includes determining a hub position or an angular orientation of the support arm, comparing the determined hub position or the angular orientation of the support arm with a predefined zone of the ride apparatus, and, based on the comparing, selecting between a base motion profile and an enhanced motion profile providing a larger magnitude of angular orientation of the support arm.

2. The apparatus of claim 1, wherein each of the travel paths defines a first angular orientation of the support arm and a second angular orientation of the support arm such that the vehicle on the support arm is moved from a first to a second height during the operating of the actuator.

3. The apparatus of claim 2, wherein at least some of the travel paths defined by the motion profiles further define a third angular orientation of the support arm such that the vehicle on the support arm is moved from the first to the second to the third height.

4. The apparatus of claim 1, wherein each of the arms is a multi jointed assembly including at least one joint actuator controlling each of a number of joints within the multi jointed assembly of the arm and wherein the motion profile defines a coordinated movement between the joint actuators providing a coordinated movement of each of the joints of the multi-jointed assembly of the arm.

5. A ride apparatus for allowing passengers to initiate vehicle movements, comprising:

a drive assembly including a structure rotatable about a central axis at one or more rotation speeds, the drive assembly further including a plurality of support arms extending outward from the structure;

a plurality of passenger vehicles each mounted proximate to an end of one of the support arms distal to the drive assembly, one or more triggering devices associated with each of the vehicles generating a discrete signal when activated by a passenger of a vehicle, wherein each of the support arms is pivotally mounted to the structure for angular rotation by an actuator to change a height of the corresponding vehicle; and a controller in communication with the actuators and the triggering devices, the controller receiving the discrete signals from the triggering devices, selecting a motion profile based on each of the received discrete signals, and operating the actuators based on the selected motion profiles to move the vehicles associated with the discrete signals through a travel path defined by a particular one of the selected motion profiles, wherein the selecting of the motion profile for use in the operating of the actuator step includes receiving environmental inputs associated with the vehicle and selecting one of the motion profiles based on a time of receipt of the discrete signal and the received environmental inputs.

6. The apparatus of claim 5, wherein the controller receives, for a particular one of the vehicles, an additional discrete signal from the triggering device in the particular vehicle during movement of the support arm according to the selected motion profile and, in response, selects an additional one of the motion profiles and operates the actuator to further move the support arm through an angular rotation defined by the additional motion profile, whereby the angular rotations are additive.

7. A method for use in a round park ride for controlling a support arm to change heights of a passenger vehicle at an end of the support arm, comprising:

with a controller, receiving a triggering input from a user input device in the passenger vehicle;

selecting, with the controller, a motion profile defining a motion profile for vertical movement of the support arm about a pivotal mount to a rotation hub of the round park ride; and generating actuator control signals based on the selected motion profile to move the support arm through the defined motion profile, whereby the passenger vehicle is moved through a plurality of heights free of additional control inputs from the passenger vehicle during the support arm movement.

8. The method of claim 7, wherein the selection of the motion profile comprises selecting the motion profile from a set of two or more motion profiles each defining a magnitude of angular rotation of the support arm to move the passenger vehicle from a first height to a second height a predefined distance above the first height.

9. The method of claim 8, further including receiving attraction status data prior to the selecting step and wherein the selecting step is performed based on processing of the received attraction status, whereby the selected motion profile differs for differing values of the attraction status data.

10. The method of claim 9, wherein the attraction status data includes at least one of arm position, hub position, game system input, show system input, and user input from at least one additional input device in the passenger vehicle.

11. The method of claim 7, further including receiving user input from an additional user input device in the passenger vehicle and wherein the selecting of the motion profile is performed based on processing of the user input from the additional user input device.

12. The method of claim 7, wherein the generating of the actuator control signals further includes modifying the defined motion profile based on received and processed attraction status data.

13. A round ride with passenger-initiated motion profiles defining movement of a support arm, comprising:

a drive and support assembly including a hub rotatable about a central axis and at least one support arm extending outward from the hub;

a vehicle mounted to an end of the support arm distal to the hub, wherein the vehicle includes a user input device generating a motion profile trigger signal when operated by a passenger of the vehicle;

an actuator in the hub for rotating the support arm to move the distal end of the support arm through a range of heights; and a control system in communication with the actuator and the user input device, the control system receiving the motion profile trigger signal, selecting, in response to the motion profile trigger system, one of a plurality of motion profiles stored in memory, and operating the actuator based on the selected motion profile to move the support arm from a first angular orientation to a second angular orientation such that the vehicle is moved at least from a first to a second height, wherein the control system further monitors attraction status and wherein the selecting is performed based on the monitored attraction status.

14. The round ride of claim 13, wherein the control system further determines hub position and arm position at a time associated with receipt of the motion profile trigger signal and wherein the selecting is performed based on at least one of the hub position and the arm position.

15. The round ride of claim 13, wherein the control system further receives a second motion profile trigger signal from the user input device within a predefined time period after the vehicle has returned to the first height from the second height and, in response, selecting one of the motion profiles that defines arm actuation from the first angular orientation to a third angular orientation at which the vehicle is at a third height greater than the second height.

16. The round ride of claim 13, wherein the control system further receives a second motion profile trigger signal from the user input device while the vehicle is dropping from the second height to the first height and, in response, operating the actuator based on one of the motion profiles to move the support arm to a third angular orientation greater in magnitude than the second angular orientation.

17. The round ride of claim 13, wherein the actuator comprises a rapid response actuator and the motion profiles define differing height jumps for the vehicle, whereby the support arm is allowed to return to the first angular orientation upon reaching the second angular orientation, and wherein the rapid response actuator moves the support arm from the first angular orientation to the second angular orientation in less than about 1 second and wherein at least some of the motion profiles define height changes of over 10 feet.

* * * * *